US007000350B2

(12) United States Patent
Weder et al.

(10) Patent No.: US 7,000,350 B2
(45) Date of Patent: Feb. 21, 2006

(54) FLORAL SLEEVE WITH DEPLOYABLE FLAP

(75) Inventors: Donald E. Weder, Highland, IL (US); Erwin Weder, Highland, IL (US)

(73) Assignee: Wanda M. Weder and William F. Straeter, Trustees of The Family Trust U/T/A dated Dec. 8, 1995, Highland, IL (US)

( * ) Notice: Subject to any disclaimer, the term of this patent is extended or adjusted under 35 U.S.C. 154(b) by 0 days.

(21) Appl. No.: 10/638,137

(22) Filed: Aug. 8, 2003

(65) Prior Publication Data

US 2005/0028444 A1 Feb. 10, 2005

(51) Int. Cl.
*A01G 9/02* (2006.01)

(52) U.S. Cl. ..... 47/72

(58) Field of Classification Search ..... 47/29.7, 47/66.3, 66.4, 73, 84, 85; 206/423
See application file for complete search history.

(56) References Cited

U.S. PATENT DOCUMENTS

| | | | |
|---|---|---|---|
| 1,044,260 A | 11/1912 | Schloss | |
| 1,063,154 A | 5/1913 | Bergen | |
| 1,446,563 A | 2/1923 | Hughes | |
| 1,520,647 A | 12/1924 | Hennigan | |
| 1,610,652 A | 12/1926 | Bouchard | |
| 1,697,751 A | 1/1929 | Blake | 229/87 |
| 1,794,212 A | 2/1931 | Snyder | |

(Continued)

FOREIGN PATENT DOCUMENTS

| | | |
|---|---|---|
| AU | 4231978 | 6/1979 |
| BE | 654427 | 1/1965 |
| CH | 560532 | 4/1975 |
| DE | 15550 | 6/1900 |
| DE | 345464 | 12/1921 |
| DE | 513971 | 11/1930 |
| DE | 1131043 | 12/1962 |

(Continued)

OTHER PUBLICATIONS

Speed Cover Brochure, "The Simple Solution For Those Peak Volume Periods", Highland Supply Corporation, ©1989.
"Speed Sheets and Speed Rolls" Brochure, Highland Supply Corporation, ©1990.
"Color Them Happy with Highlander Products" ©1992.
"Costa Keeps the Christmas Spirit", Supermarket Floral, Sep. 15, 1992.
"Super Seller", Supermarket Floral, Sep. 15, 1992.

(Continued)

*Primary Examiner*—Francis T. Palo
(74) *Attorney, Agent, or Firm*—Dunlap, Codding & Rogers, P.C.

(57) ABSTRACT

A flexible sleeve for containing a pot and/or floral grouping and/or growing or retaining medium. The flexible sleeve has a body and a flap. The body has an outer peripheral surface, an inner peripheral surface and a skirt. The flap is connected to the inner peripheral surface of the body, preferably near the skirt. The flap is adapted to be positioned in: a storage position extending downward, a receiving position extending upward, and a deployed position extending substantially inwardly from the inner peripheral surface of the body when the body is in an open configuration. The flap can be a sheet, or may be folded or slitted. Water or other chemicals may be impregnated into the flap to aid in the maintenance of the floral grouping or growing medium. The flap may also be used to secure the sleeve about the pot and/or floral grouping and/or growing or retaining medium.

26 Claims, 5 Drawing Sheets

U.S. PATENT DOCUMENTS

| | | | | | |
|---|---|---|---|---|---|
| 1,811,574 | A | | 6/1931 | Barrett | |
| 2,200,111 | A | | 5/1940 | Bensel | 229/1.5 |
| 2,323,287 | A | | 7/1943 | Amberg | 229/53 |
| 2,355,559 | A | | 8/1944 | Renner | 229/8 |
| 2,529,060 | A | | 11/1950 | Trillich | 117/68.5 |
| 2,850,842 | A | | 9/1958 | Eubank, Jr. | 47/58 |
| 2,989,828 | A | | 6/1961 | Warp | 53/390 |
| 3,021,046 | A | * | 2/1962 | Pullen | 47/84 |
| 3,022,605 | A | | 2/1962 | Reynolds | 47/58 |
| 3,080,680 | A | | 3/1963 | Reynolds | 47/37 |
| 3,094,810 | A | | 6/1963 | Kalpin | 47/37 |
| 3,271,922 | A | | 9/1966 | Wallerstein et al. | 53/3 |
| 3,316,675 | A | | 5/1967 | Cartwright, Jr. | |
| 3,322,325 | A | | 5/1967 | Bush | 229/62 |
| 3,376,666 | A | | 4/1968 | Leonard | 47/41 |
| 3,380,646 | A | | 4/1968 | Doyen et al. | 229/57 |
| 3,431,706 | A | | 3/1969 | Stuck | 53/390 |
| 3,508,372 | A | | 4/1970 | Wallerstein et al. | 53/3 |
| 3,512,700 | A | | 5/1970 | Evans et al. | 229/53 |
| 3,550,318 | A | | 12/1970 | Remke et al. | 47/37 |
| 3,552,059 | A | | 1/1971 | Moore | 47/41.12 |
| 3,554,434 | A | | 1/1971 | Anderson | 229/55 |
| 3,556,389 | A | | 1/1971 | Gregoire | 229/53 |
| 3,620,366 | A | | 11/1971 | Parkinson | 206/59 |
| 3,869,828 | A | | 3/1975 | Matsumoto | 47/34.11 |
| 3,962,503 | A | | 6/1976 | Crawford | 428/40 |
| 4,043,077 | A | | 8/1977 | Stonehocker | 47/66 |
| 4,091,925 | A | * | 5/1978 | Griffo et al. | 206/423 |
| 4,118,890 | A | | 10/1978 | Shore | 47/28 |
| 4,149,339 | A | | 4/1979 | Hall et al. | 47/67 |
| 4,158,631 | A | | 6/1979 | Whelan | 210/497 |
| 4,189,868 | A | | 2/1980 | Tymchuck et al. | 47/84 |
| 4,216,620 | A | | 8/1980 | Weder et al. | 47/72 |
| 4,248,347 | A | | 2/1981 | Trimbee | 206/423 |
| D259,333 | S | | 5/1981 | Charbonneau | D9/306 |
| 4,265,049 | A | | 5/1981 | Gorewitz | 47/26 |
| 4,280,314 | A | | 7/1981 | Stuck | 53/241 |
| 4,333,267 | A | | 6/1982 | Witte | 47/84 |
| 4,347,686 | A | | 9/1982 | Wood | 47/73 |
| 4,400,910 | A | | 8/1983 | Koudstall et al. | 47/84 |
| 4,413,725 | A | | 11/1983 | Bruno et al. | 206/45.33 |
| D279,279 | S | | 6/1985 | Wagner | D11/143 |
| 4,621,733 | A | | 11/1986 | Harris | 206/423 |
| 4,640,079 | A | | 2/1987 | Stuck | 53/390 |
| 4,717,262 | A | | 1/1988 | Roen et al. | 383/120 |
| 4,733,521 | A | | 3/1988 | Weder et al. | 53/580 |
| 4,773,182 | A | | 9/1988 | Weder et al. | 47/72 |
| 4,801,014 | A | | 1/1989 | Meadows | 206/423 |
| 4,810,109 | A | | 3/1989 | Castel | 383/105 |
| 4,813,177 | A | * | 3/1989 | Brilliande | 47/66.4 |
| 4,835,834 | A | | 6/1989 | Weder | 29/525 |
| D301,991 | S | | 7/1989 | Van Sant | D11/149 |
| 4,915,224 | A | * | 4/1990 | Wulf et al. | 206/423 |
| 4,941,572 | A | | 7/1990 | Harris | 206/423 |
| 4,980,209 | A | | 12/1990 | Hill | 428/34.1 |
| 4,989,396 | A | | 2/1991 | Weder et al. | 53/397 |
| D315,700 | S | | 3/1991 | Stephens | D11/151 |
| D317,424 | S | | 6/1991 | Weder | |
| D317,582 | S | | 6/1991 | Weder | |
| D318,029 | S | | 7/1991 | Weder | |
| D322,233 | S | | 12/1991 | Weder | |
| 5,073,161 | A | | 12/1991 | Weder et al. | 493/154 |
| 5,074,675 | A | | 12/1991 | Osgood | 383/122 |
| 5,105,599 | A | | 4/1992 | Weder | 53/399 |
| D326,246 | S | | 5/1992 | Weder | |
| 5,111,638 | A | | 5/1992 | Weder | 53/397 |
| D326,628 | S | | 6/1992 | Weder | |
| D326,830 | S | | 6/1992 | Vaughn | |
| D327,236 | S | | 6/1992 | Weder | |
| 5,120,382 | A | | 6/1992 | Weder | 156/212 |
| 5,152,100 | A | | 10/1992 | Weder et al. | 47/72 |
| 5,181,364 | A | | 1/1993 | Weder | 53/397 |
| D335,105 | S | | 4/1993 | Ottenwalder et al. | D11/164 |
| 5,199,242 | A | | 4/1993 | Weder et al. | 53/397 |
| 5,205,108 | A | | 4/1993 | Weder et al. | 53/397 |
| 5,228,234 | A | | 7/1993 | de Klerk et al. | 47/41.01 |
| 5,235,782 | A | | 8/1993 | Landau | 47/72 |
| 5,239,775 | A | | 8/1993 | Landau | 47/72 |
| 5,249,407 | A | | 10/1993 | Stuck | 53/399 |
| 5,259,106 | A | | 11/1993 | Weder et al. | 29/469.5 |
| 5,307,606 | A | | 5/1994 | Weder | 53/410 |
| 5,315,785 | A | | 5/1994 | Aŷot et al. | 47/72 |
| 5,335,475 | A | | 8/1994 | Weder et al. | 53/397 |
| 5,350,240 | A | | 9/1994 | Billman et al. | 383/104 |
| 5,353,575 | A | | 10/1994 | Stepanek | 53/461 |
| 5,361,482 | A | | 11/1994 | Weder et al. | 29/469 |
| 5,388,695 | A | | 2/1995 | Gilbert | 206/423 |
| 5,410,856 | A | | 5/1995 | Weder et al. | 53/397 |
| 5,428,939 | A | | 7/1995 | Weder et al. | 53/397 |
| 5,443,670 | A | | 8/1995 | Landau | 156/191 |
| D363,450 | S | | 10/1995 | Weder et al. | |
| D364,113 | S | | 11/1995 | Weder et al. | |
| D365,306 | S | | 12/1995 | Weder et al. | |
| D366,228 | S | | 1/1996 | Weder et al. | |
| 5,493,809 | A | | 2/1996 | Weder et al. | 47/72 |
| D368,025 | S | | 3/1996 | Sekerak et al. | D9/305 |
| 5,496,251 | A | | 3/1996 | Cheng | 493/224 |
| 5,496,252 | A | | 3/1996 | Gilbert | 493/224 |
| 5,526,932 | A | | 6/1996 | Weder | 206/423 |
| 5,551,570 | A | | 9/1996 | Shaffer et al. | 206/575 |
| 5,572,849 | A | | 11/1996 | Weder et al. | 53/399 |
| 5,572,851 | A | | 11/1996 | Weder | 53/399 |
| 5,595,048 | A | | 1/1997 | Weder et al. | 53/399 |
| 5,617,703 | A | | 4/1997 | Weder | 53/413 |
| 5,624,320 | A | | 4/1997 | Martinez | 472/51 |
| 5,625,979 | A | | 5/1997 | Weder | |
| 5,647,168 | A | | 7/1997 | Gilbert | 47/72 |
| 5,647,193 | A | | 7/1997 | Weder et al. | 53/465 |
| D385,215 | S | | 10/1997 | Weder et al. | |
| 5,715,944 | A | | 2/1998 | Windisch | 206/423 |
| 5,845,775 | A | | 12/1998 | Weder et al. | 206/423 |
| D404,684 | S | | 1/1999 | Shea | D11/164 |
| 5,974,730 | A | | 11/1999 | Chien | 47/41.01 |
| 6,000,544 | A | | 12/1999 | Weder et al. | 206/423 |
| D419,436 | S | | 1/2000 | Celtorius et al. | D9/305 |
| 6,098,336 | A | | 8/2000 | Ferguson | 206/423 |
| 6,129,208 | A | | 10/2000 | Ferguson | 206/423 |
| 6,129,209 | A | | 10/2000 | Tchira | 206/423 |
| 6,357,205 | B1 | * | 3/2002 | Weder | 53/397 |
| 6,446,805 | B1 | * | 9/2002 | Mann et al. | 206/423 |
| 2001/0049903 | A1 | | 12/2001 | Gilbert | |
| 2003/0173245 | A1 | * | 9/2003 | Story | 206/423 |

FOREIGN PATENT DOCUMENTS

| | | | |
|---|---|---|---|
| DE | 1166692 | | 3/1964 |
| DE | 1962947 | | 6/1971 |
| DE | 2060812 | | 11/1971 |
| DE | 2748626 | | 5/1979 |
| DE | 3445799 | | 6/1986 |
| DE | 3601207 | | 7/1987 |
| DE | 3829281 | | 5/1989 |
| DE | 3911847 | | 10/1990 |
| EP | 21963 | A1 * | 1/1981 |
| EP | 0050990 | | 5/1982 |
| EP | 0791543 | | 8/1997 |
| FR | 1376047 | | 9/1964 |
| FR | 2036163 | | 12/1970 |
| FR | 2137325 | | 12/1972 |
| FR | 2272914 | | 12/1975 |
| FR | 2489126 | | 3/1982 |
| FR | 2610604 | | 8/1988 |

| | | |
|---|---|---|
| FR | 2603159 | 3/1989 |
| FR | 2619698 | 3/1989 |
| FR | 2651663 | 9/1989 |
| GB | 5605 | of 1885 |
| GB | 1204647 | 9/1970 |
| GB | 2056410 | 3/1981 |
| GB | 2074542 | 11/1981 |
| GB | 2128083 | 4/1984 |
| GB | 2212136 | 7/1989 |
| GB | 2252708 | 8/1992 |
| GB | 2203127 | 10/1998 |
| IT | 224507 | 4/1996 |
| JP | 542958 | 2/1993 |
| JP | 6127555 | 5/1994 |
| JP | 8-19334 | 1/1996 |
| NL | 8301709 | 12/1984 |
| NL | 8702204 | 9/1986 |
| NL | 1000658 | 1/1996 |
| WO | 9315979 | 8/1993 |
| WO | 9712819 | 4/1997 |

OTHER PUBLICATIONS

"Halloween", Link Magazine, Sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec., 1996, 2 pages.
"Derwent Abstract" of FR 2610604A. It is noted that the abstract is an incorrect English translation of the contents of the French patent. The French patent does not enable or disclose adhesively attaching the covering to the container, 1988.
"Silver Linings" Brochure, Affinity Diversified Industries, Inc., 1986. The Silver Linings brochure shows a floral sleeve with a closed bottom. The brochure shows , in one embodiment, a vase with flowers inside a "cut flower" sleeve with the sleeve tied with a ribbon about the neck of the vase.
"Special Occasion Printed Highlophane Bags" Brochure, Highland Supply Corporation, 1990, 2 pages.
"Creative Packaging" Brochure, John Henry Company, Sep. 1992.
"Make Highlander Your Headquarters" Brochure, Highland Supply Corporation, 1991.

* cited by examiner

FLORAL SLEEVE WITH DEPLOYABLE FLAP

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

This invention generally relates to floral sleeves, and more particularly, sleeves used to wrap flower pots containing floral groupings and/or mediums containing floral groupings, and methods of using same.

SUMMARY OF THE INVENTION

The invention contemplated herein a sleeve for containing a pot having a floral grouping disposed therein or for containing a floral grouping, with or without a growth or retaining medium. In a preferred embodiment, the sleeve has a body and a flap disposed within and attached to the body. The flap is adapted to placed in a deployed position extending inwardly from an inner peripheral surface of the body when a pot and a floral grouping and growing medium has been disposed within the sleeve.

DESCRIPTION OF THE PREFERRED EMBODIMENTS

Figure 1:
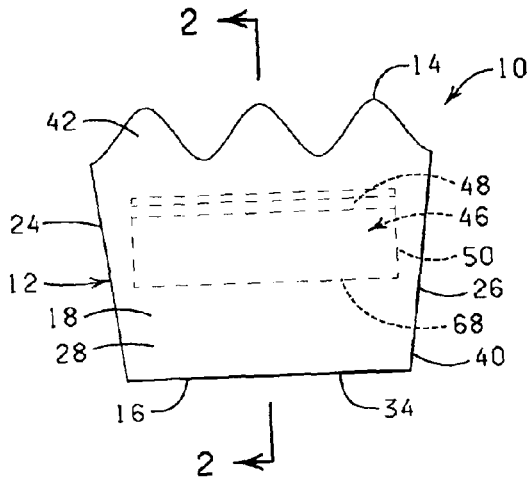
FIG. 1 is an elevational view of a sleeve having one flap, constructed in accordance with the present invention.

Shown in FIGS. 1 through 6 and designated therein by the general reference numeral 10 is a flexible bag known in the art as a sleeve. The sleeve 10 has a body 12 and preferably is constructed in a flattened state which is openable into an opened condition for containing a pot or floral grouping. The body 12 is preferably tapered from a lower end 16 toward a larger diameter at an upper end 14 as shown in FIG. 1 wherein the body 12 has a substantially frusto-conical shape when opened. In the flattened state the body 12 may have an overall trapezoidal, modified trapezoidal or contoured (non-linear) shape. It will be appreciated, however, that the body 12 may comprise variations on the aforementioned shapes or may comprise significantly altered shapes such as square or rectangular, wherein the body 12 when opened has a cylindrical form, as long as the body 12 functions in accordance with the present invention in the manner described herein.

Figure 2:
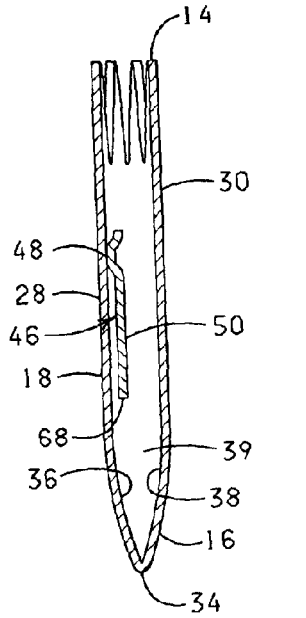
FIG. 2 is a cross sectional view of the sleeve of FIG. 1.

As shown in FIG. 1, the body 12 has the upper end 14, the lower end 16 and an outer peripheral surface 18. The body 12 initially has a flattened state and in its flattened state the body 12 has a first edge 24, a second edge 26, a first panel 28 and a second panel 30 (FIG. 2). In an opened configuration (FIG. 3), the body 12 has an opening 32 at the upper end 14. Preferably, the body 12 is closed at the lower end 16. In one embodiment, the lower end 16, when closed, has a gusset (not shown) but as shown in FIG. 1 is simply sealed along a lower edge 34. The first panel 28 has a first inner peripheral surface 36 and the second panel 30 has a second inner peripheral surface 38 (FIG. 2) which together, when the body 12 is opened, cooperate to define and encompass an interior space 39. When present, the gusset may be constructed in a manner well known by those of ordinary skill in the art. Therefore, further description of the gussets is not deemed necessary herein.

The body 12 preferably comprises a base portion 40, which is sized to surround a pot 41 (FIGS. 5–6) when the pot 41 is placed in the sleeve 10, and a decorative skirt portion 42 which preferably extends beyond an upper rim of the pot 41 when the pot 41 is disposed within the base portion 40 of the body 12. The skirt portion 42 may extend straight from or at angle, inwardly or outwardly, from the base portion 40.

As shown in FIGS. 1 and 2, the body 12 of the sleeve 10 has a flap 46 attached to a portion of the first inner peripheral surface 36 or second inner peripheral surface 38 of the body 12, for example, the flap 46 is attached to the skirt portion 42 near the base portion 40 of the body 12. The flap 46 is connected at an attached area 48 and has an extending portion 50 which extends a distance from the attached area 48. The attached area 48 may be positioned at any location on the first inner peripheral surface 36 or second inner peripheral surface 38 as long as the flap 46 functions in accordance with the present invention.

Figure 3:
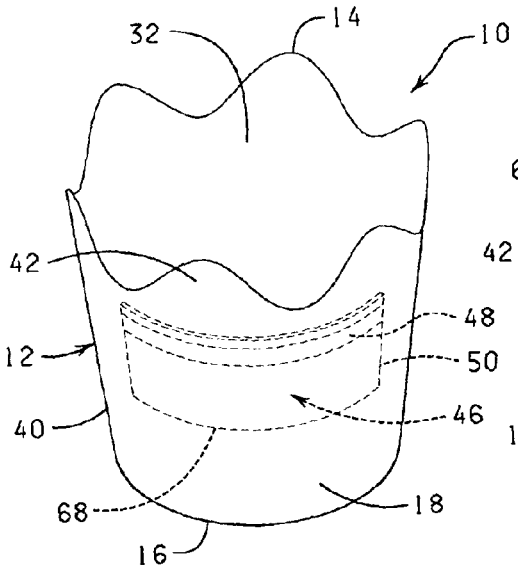
FIG. 3 is a perspective view of the sleeve of FIG. 1 with the body open and the flap disposed in a storage position.
Figure 6:
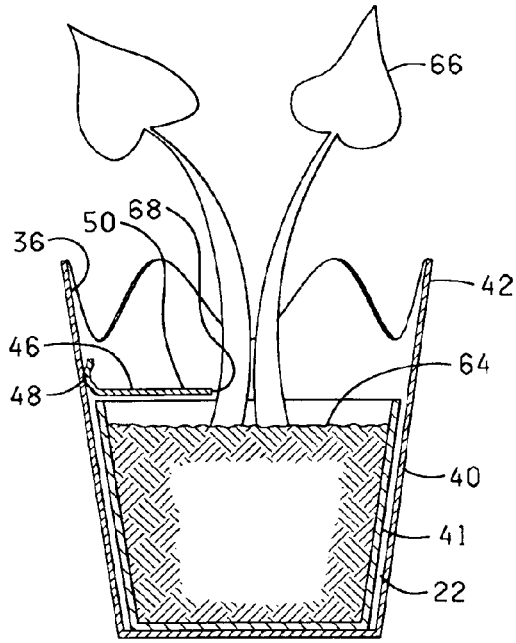
FIG. 6 is a cross sectional view of the sleeve of FIG. 5.

In one embodiment, as shown in FIGS. 1–3, the flap 46 is downwardly oriented while in a storage position wherein the flap 46 rests substantially against the inner peripheral surface 36 of the body 12. When the sleeve 10 is in an open configuration, the flap 46 can be disposed in an upward orientation (FIG. 4) by pivoting the flap 46 upwardly near the upper end 14 of the sleeve 10 to enable the sleeve 10 to receive a pot or floral grouping. In the open configuration, the flap 46 preferably extends above the upper end 14 of the body 12, where an inner curvature of the body 12 acts to maintain the flap 46 in an upward orientation. Once the pot 41 is disposed into the base portion 40 of the opened body 12 of the sleeve 10, the flap 46 can be maintained in a deployed position (FIGS. 5–6), wherein the flap 46 extends substantially inwardly from the first inner peripheral surface 36, so that the extending portion 50 rests upon or above a growing or retaining medium 64 in the pot 41 (FIG. 6).

Figure 4:
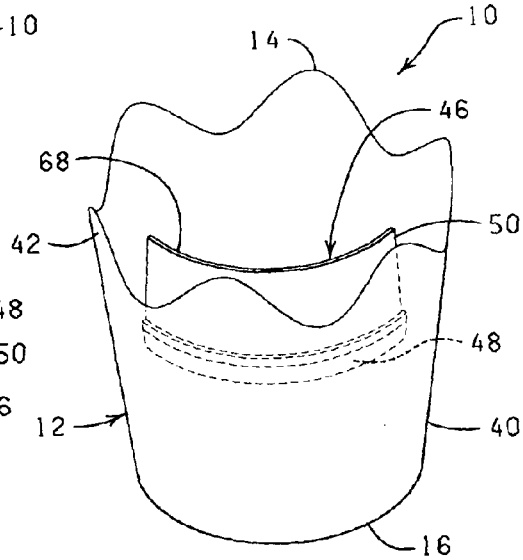
FIG. 4 is a perspective view of the sleeve of FIG. 1 with the body open and the flap disposed in a receiving position.
Figure 5:
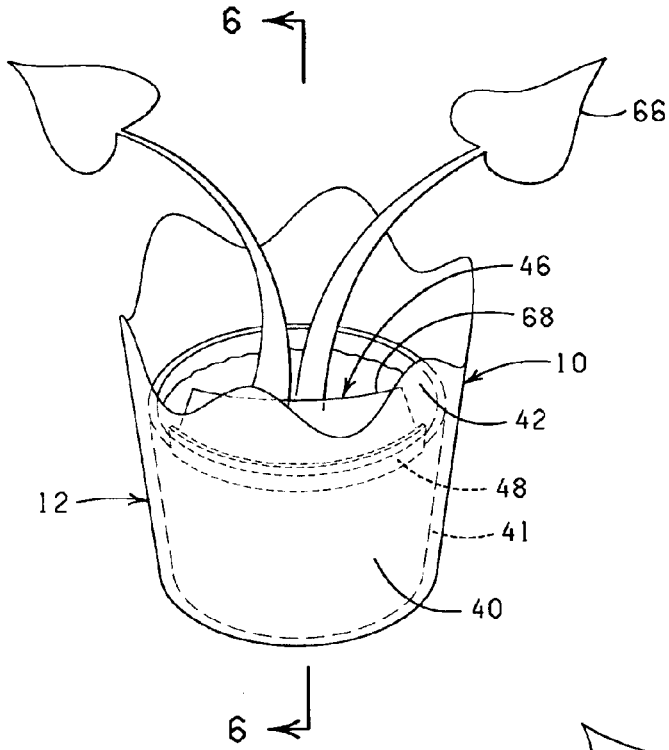
FIG. 5 is a perspective view of the sleeve of FIG. 1 with the body open and the flap disposed in a deployed position with a potted plant disposed therein.

During operation, the sleeve 10 is opened in anticipation of disposing the pot 41 within the interior space 39 of the body 12. After opening, the flap 46 is moved from the storage position (FIG. 1–3) to the receiving position (FIG. 4). After the pot 41 is disposed in the sleeve 10, the flap 46 is then moved from the receiving position to the deployed position (FIGS. 5–6), thus bringing the flap 46 adjacent or covering the growing medium 64 and optionally securing the sleeve 10 about the pot 41.

When the flap 46 is in the deployed position (FIGS. 5–6), the flap 46 may also serve as a means for securing the sleeve 10 in a position about the pot 41. Alternately, a bonding material or other securing element may be used to secure the sleeve 10 about the pot 41 having a floral grouping 66 therein when such a pot 41 is disposed within the sleeve 10.

While a peripheral edge 68 (FIGS. 1–6) of the flap 46 is depicted as being substantially horizontal or arcuate, the peripheral edge 68 can be of any shape including round, inverted round, scalloped, inverted scalloped, sine wave, zig-zag, square wave, diagonal, repeating diagonal or any other shape.

The flap 46 may be connected to the body 12 by a weld strip, by a series of weld points, an adhesive material, a cohesive material, a tape, a staple, or any other method known in the art for connecting one sheet of material to another. The flap 46 could also be detachable from the body 12 of the sleeve 10 via a detaching element near the respective attached areas 48.

While the flap 46 is shown as being pre-connected to the body 12, the flap 46, in an alternate embodiment, could be connectable to the body 12 after the pot 41 is disposed into the sleeve 10. In this embodiment, the body 12 of the sleeve 10 would be opened in anticipation of receiving the pot 41 into the body 12. The pot 41 would be disposed in the body 12, then the flap 46 would be connected to the body 12 to form the sleeve 10. Preferably, the flap 46 would be connected to the body 12 in the receiving position. Once connected, the flap 46 would then be disposed in the deployed position.

The flap 46 may be clear, colored, or printed, as disclosed above for the entire sleeve 10. In the preferred embodiment, the flap 46 has the same decoration as the body 12 of the sleeve 10.

The flap 46 may be constructed of any material, as described herein for the body 12 or for the entire sleeve 10. In the preferred embodiment, the flap 46 is constructed of the same material as the sleeve 10.

The flap 46 can serve a number of functions. In one embodiment, the flap 46 is constructed of a water impermeable material and serves to condense ambient water evaporated from the growing medium 64 to minimize or prevent water loss. Such a flap 46 could also be useful to funnel water or other chemicals into the pot 41. When a thicker or denser or insulative material is used to construct the flap 46, the flap 46 can be used to maintain or stabilize the temperature of the growing medium 64 in the pot 41.

When a fibrous material, such as fiber, cloth, burlap or fabric is used to construct the flap 46, the flap 46 can be used as a wick. In one embodiment, the flap 46 can be used to wick away moisture from the growing or retaining medium 64. In another embodiment, the flap 46 can be saturated with water, to keep the growing medium 64 wet. The flap 46 can also be impregnated with a chemical such as a fertilizer, an insect repellant, an insecticide, a fungicide, a herbicide, a bactericide or any other desirable chemical to aid in the maintenance of the growing medium 64 and the floral grouping 66. The flap 46 can be impregnated with a crystalizing chemical by immersion in a solution super saturated with the crystalizing chemical. By lowering the temperature, the chemical can be made to crystalize around the flap 46, thus allowing the flap 46 to disperse the chemical in a time-released fashion. Alternatively, the flap 46 can be soaked with a chemical mixed with layers of a slowly dissolving gel, thus facilitating a timed release of the chemical.

As described above, the flap 46 can be made of a fibrous material. This includes materials that change color when wet. Use of such fibrous materials, in combination with the wicking properties of fibrous materials can provide the flap 46 with the ability to indicate the moisture level of the growing medium 64, thus giving the flap 46 the ability to indicate when the floral grouping 66 needs watering.

A primary use of the flap 46 is as a means for decoratively covering the growing medium 64 in the pot 41. As such, the flap 46 can be colored to simulate the appearance of the growing medium 64, thus concealing the presence of the flap 46. It should be understood that while the various uses of the flap 46 are separately enumerated, any combination of the above uses for the flap 46 falls within the scope of this invention.

The flap 46 can be any shape such as round, semicircular, triangular, polygonal or any other shape which allows the flap 46 to function in accordance with the present invention.

When the flap 46 is in the deployed position (FIGS. 5–6), the material of the extending portion 50 may tend to deform as the extending portion 50 approaches the center of the interior space 39 thereby permitting the flap 46 to conform to the shape of the growing or retaining medium 64, and allows the flap 46 to be wrapped about a stem of the floral grouping 66. In order to control or promote the deformation, the flap 46 may have folds disposed thereon. Furthermore, instead of or with such folds, the flap 46 may have slits to facilitate disposition of the flap 46 in the deployed position.

Figure 7:
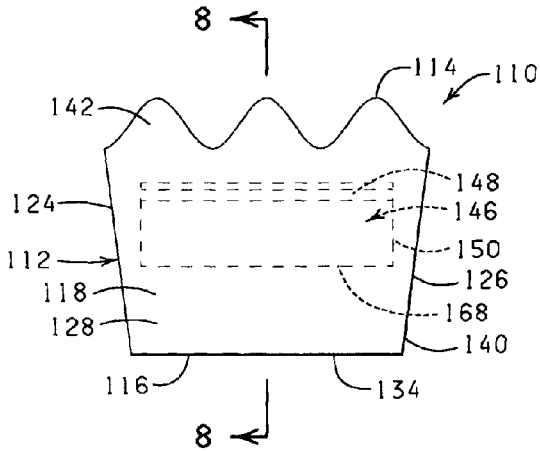
FIG. 7 is an elevational view of a sleeve having two flaps, constructed in accordance with the present invention.

Shown in FIGS. 7–12 is an alternate embodiment of the sleeve of the present invention designated by the general reference numeral 110. The sleeve 110 is similar to sleeve 10 in that the sleeve 110 has a body 112 and preferably is constructed in a flattened state which is openable into an opened condition for containing a pot or floral grouping as describes elsewhere herein. Sleeve 110, however, differs from sleeve 10 in that sleeve 110 has a pair of flaps rather than a single flap. The body 112 is preferably tapered from a lower end 116 toward a larger diameter at an upper end 114 as shown in FIG. 7, wherein the body 112 has a substantially frusto-conical shape when opened. In its flattened state the body 112 may have an overall trapezoidal, modified trapezoidal or contoured (non-linear) shape. It will be appreciated, however, that the body 112 may comprise variations on the aforementioned shapes or may comprise significantly altered shapes such as square or rectangular, wherein the body 112 when opened has a cylindrical form, as long as the body 112 functions in accordance with the present invention in the manner described herein.

Figure 8:
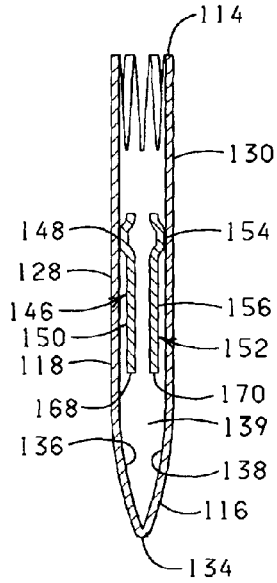
FIG. 8 is a cross sectional view of the sleeve of FIG. 7.

As shown in FIG. 7, the body 112 has an outer peripheral surface 118 as well as the upper end 114 and a lower end 116. The body 112 initially has a flattened state and in its flattened state the body 112 has a first edge 124, a second edge 126, a first panel 128 and a second panel 130 (FIG. 8). In an opened configuration (FIG. 9), the body 112 has an opening 132 at the upper end 114. Preferably, the body 112 is closed at the lower end 116. Preferably the lower end 116, when closed, has a gusset (not shown) but as shown in FIG. 7 is simply sealed along a lower edge 134. The first panel 128 has a first inner peripheral surface 136 (FIG. 8) and the second panel 130 has a second inner peripheral surface 138 (FIG. 8) which together, when the body 112 is opened, cooperate to define and encompass an interior space 139. When present, the gusset may be constructed in a manner well known by those of ordinary skill in the art, as explained above. Therefore, further description of the gussets is not deemed necessary herein.

The body 112 preferably comprises a base portion 140, which is sized to surround a pot 141 (FIGS. 11–12) when the pot 141 is placed in the sleeve 110, and a decorative skirt portion 142 which preferably extends beyond an upper rim of the pot 141 when the pot 141 is disposed within the base portion 140 of the body 112. The skirt portion 142 may extend straight from or at angle, inwardly or outwardly, from the base portion 140.

As shown in FIGS. 7 and 8, the body 112 of the sleeve 110 has a first flap 146 attached to a portion of the first inner peripheral surface 136 of the body 112, for example, the first flap 146 is attached to the skirt portion 142 near the base portion 140 of the body 112. The flap 146 is connected at an attached area 148 and has an extending portion 150 which extends a distance from the attached area 148. The attached area 148 may be positioned at any location on the first inner peripheral surface 136 or second inner peripheral surface 138 as long as the flap 146 functions in accordance with the present invention.

Shown in FIG. 8, the body 112 of the sleeve 110 has a second flap 152 attached to a portion of the second inner peripheral surface 138 of the body 112, for instance, the second flap 152 is attached to the skirt portion 142 near the base portion 140 of the body 112. The flap 152 is connected at an attached area 154 and has an extending portion 156 which extends a distance from the attached area 154. The attached area 154 may be positioned at any location on the second inner peripheral surface 138 as long as the flap 152 functions in accordance with the present invention.

Figure 9:
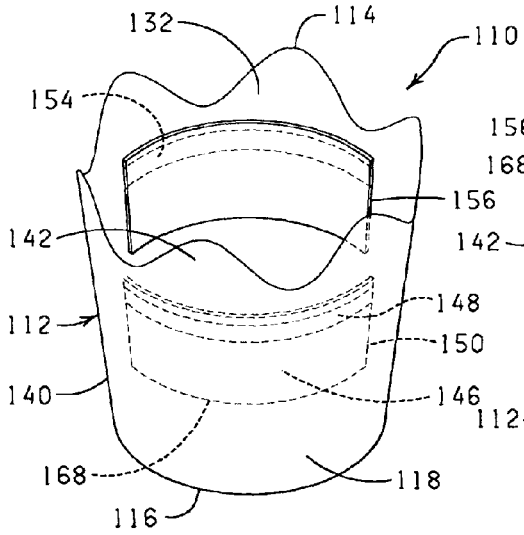
FIG. 9 is a perspective view of the sleeve of FIG. 7 with the body open and the flaps disposed in a storage position.

In one embodiment, as shown in FIGS. 7–9, the flaps 146 and 152 are downwardly oriented in a storage position wherein the flaps 146 and 152 rest substantially against the respective inner peripheral surfaces 136 and 138 of the body 112. When the sleeve 110 is in an open configuration, the flaps 146 and 152 can be disposed in an upward orientation (FIG. 10) by pivoting the flaps 146 and 152 upwardly near the upper end 114 of the sleeve 110 to enable the sleeve 110 to receive the pot 141 and/or a floral grouping 166. In the open configuration, the flaps 146 and 152 preferably extend above the upper end 114 of the body 112, where an inner curvature of the body 112 may act to maintain the flaps 146 and 152 in an upward orientation. Once the pot 141 is disposed into the base portion 140 of the opened body 112 of the sleeve 110, the flaps 146 and 152 can be maintained in a deployed position (FIGS. 11–12), where the flaps 146 and 152 extend substantially inwardly from the respective inner peripheral surfaces 136 and 138 (FIG. 12), so that the extending portions 150 and 156 rest upon or above a growing or retaining medium 164 in the pot 141.

Figure 10:
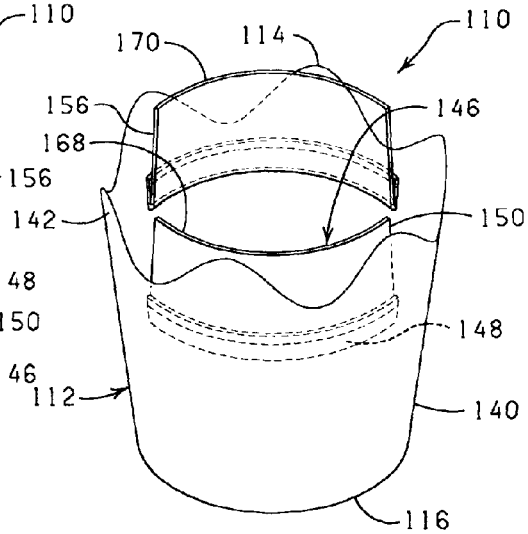
FIG. 10 is a perspective view of the sleeve of FIG. 7 with the body open and the flaps disposed in a receiving position.
Figure 11:
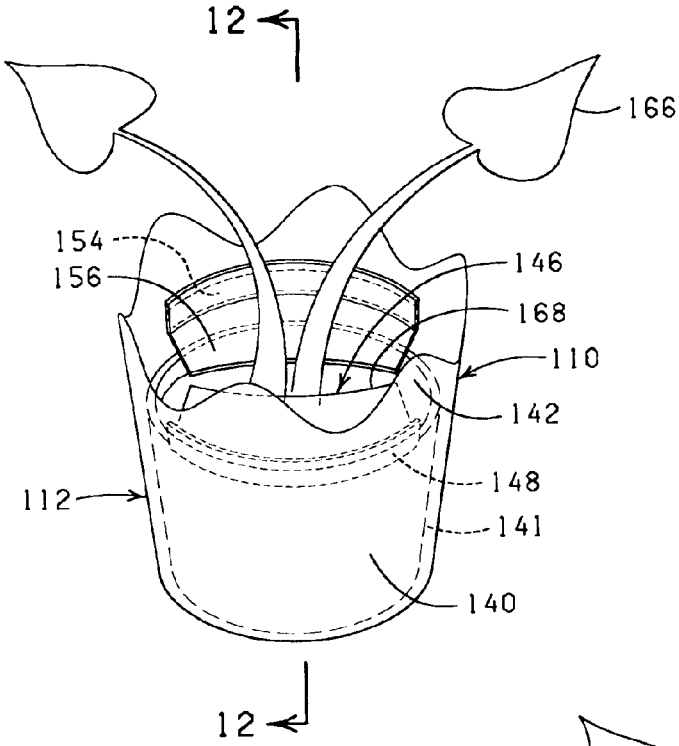
FIG. 11 is a perspective view of the sleeve of FIG. 7 with the body open and the flaps disposed in a deployed position with a potted plant disposed therein.
Figure 12:
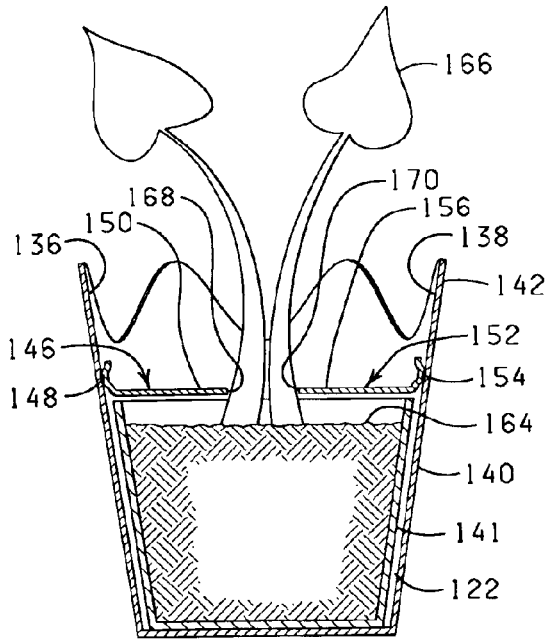
FIG. 12 is a cross sectional view of the sleeve of FIG. 11.

During operation, the sleeve 110 is opened in anticipation of disposing the pot 141 within the interior space 139 of the body 112. After opening, the flaps 146 and 152 are moved from the storage position (FIG. 7–9) to the receiving position (FIG. 10). After the pot 141 is disposed in the sleeve 110, the flaps 146 and 152 are then moved from the receiving position to the deployed position (FIGS. 11–12), thus bringing the flaps 146 and 152 adjacent to or covering the growing medium 164 and/or lower position of the floral grouping 166 and optionally securing the sleeve 110 about the pot 141.

When the flaps 146 and 152 are in the deployed position (FIGS. 11–12), the flaps 146 and 152 may also serve as a means for securing the sleeve 110 in a position about the pot 141. Alternately, a bonding material or other securing element may be used to secure the sleeve 110 about the pot 141 having the floral grouping 166 therein when such a pot 141 is disposed within the sleeve 110.

While peripheral edges 168 and 170 (FIGS. 7–12) of the flaps 146 and 152 are depicted as being substantially horizontal or arcuate, the peripheral edges 168 and 170 can be of any shape including round, inverted round, scalloped, inverted scalloped, sine wave, zig-zag, square wave, diagonal, repeating diagonal or any other shape.

The flaps 146 and 152 may be connected to the body 112 by a weld strip, by a series of weld points, an adhesive material, a cohesive material, a tape, a staple, or any other method known in the art for connecting one sheet of material to another. The flaps 146 and 152 could also be detachable from the body 112 of the sleeve 110 via a detaching element near the respective attached areas 148 and 154.

While the flaps 146 and 152 are shown as being pre-connected to the body 112, the flaps 146 and 152, in an alternate method, could be connectable to the body 112 after the pot 141 was disposed into the sleeve 110. In this embodiment, the body 112 of the sleeve 110 would be opened in anticipation of receiving the pot 141 into the body 112. The pot 141 would be disposed in the body 112. After that, the flaps 146 and 152 would be connected to the body 112 to form the sleeve 110. Preferably, the flaps 146 and 152 would be connected to the body 112 in the receiving position. Once connected, the flaps 146 and 152 would then be disposed in the deployed position.

The flaps 146 and 152 may be clear, colored, or printed, as disclosed above for the entire sleeve 110. In the preferred embodiment, the flaps 146 and 152 have the same decoration as the body 112 of the sleeve 110.

The flaps 146 and 152 may be constructed of any material, as described herein for the body 112 or for the entire sleeve 110. In the preferred embodiment, the flaps 146 and 152 are constructed of the same material as the sleeve 110.

Flaps 146 and 152 function in a manner similar to flap 46 of sleeve 10, as described earlier.

The flaps 146 and 152 can be any shape such as round, semicircular, triangular, polygonal or any other shape which allows the flaps 146 and 152 to function in accordance with the present invention.

When the flaps 146 and 152 are in the deployed position (FIGS. 11–12), the material of the extending portions 150 and 156 may tend to deform as the extending portions 150 and 156 approach the center of the interior space 139, thereby permitting the flaps 146 and 152 to conform to the shape of the growing or retaining medium 164, and allows the flaps 146 and 152 to be wrapped about a stem of the floral grouping 166. In order to control or promote the deformation, the flaps 146 and 152 may have folds disposed thereon. Furthermore, instead of or with such folds, the flaps 146 and 152 may have slits to facilitate disposition of the flaps 146 and 152 in the deployed position.

Figure 13:
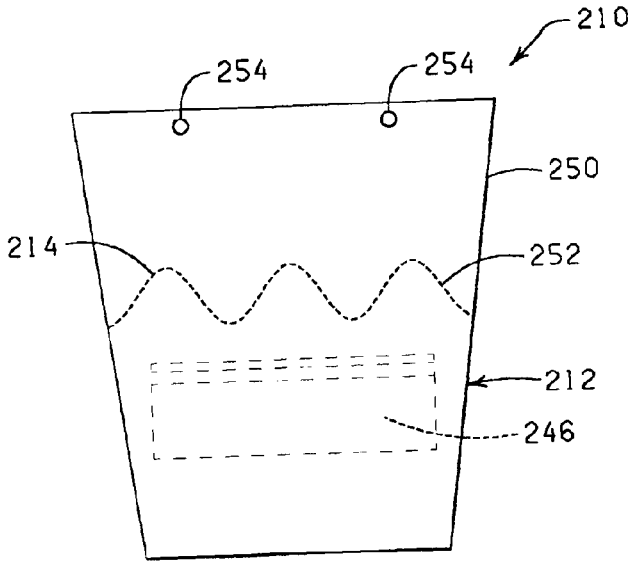
FIG. 13 is an elevational view of a sleeve with an upper sleeve portion extending from the upper end of the sleeve.

Another embodiment, as shown in FIG. 13 and designated therein by the general reference numeral 210 is a flexible bag known in the art as a sleeve. The sleeve 210 is similar in construction to the sleeve 10 of FIG. 1 and has all the features of the sleeve 10 of FIG. 1, such as a body 212, an upper end 214, a base portion 240 adapted to encompass a pot 241 (not shown), a skirt portion 242 and a flap 246. However, the sleeve 210 of FIG. 13 differs from the sleeve 10 of FIG. 1, in that the sleeve 210 has an upper portion 251 extending a distance from the upper end 214 of the body 212. The upper portion 251 is connected to the body 212 by a detaching element 253, that permits the upper portion 251 to be detached from the body 212, leaving only the body 212 behind. The upper portion 251 may be sized to surround and enclose the floral grouping 66 disposed within the pot 41 and may comprise holes 254 for enabling the sleeve 210 to be supported from a support assembly such as a wicket (not shown).

Figure 14:
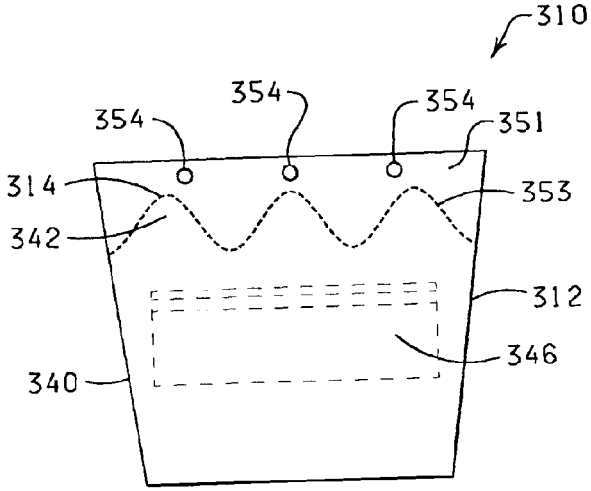
FIG. 14 is an elevational view of a sleeve with an upper sleeve portion extending a short distance from the upper end of the sleeve, the upper sleeve portion having holes for the prongs of a wicket.

An alternative embodiment, as shown in FIG. 14 and designated therein by the general reference numeral 310 is a flexible bag known in the art as a sleeve. The sleeve 310 is similar in construction to the sleeve 210 of FIG. 13 and has all the features of the sleeve 210 of FIG. 13, such as a body 312, an upper end 314, a base portion 340 adapted to encompass a pot, a skirt portion 342, a flap 346, an upper portion 351 and a detaching element 353. However, the sleeve 310 of FIG. 14 differs from the sleeve 210 of FIG. 13, in that the upper portion 351 of the sleeve 310 extends a lesser distance from the upper end 314 of the sleeve 310. The sleeve 310 has a plurality of holes 354 disposed in the upper portion 351 to enable the sleeve 310 to be supported from a support assembly such as a wicket. In operation the sleeve 310 is disposed so that the prongs of a wicket extend through the holes 354 of the sleeve 310. When a user desires to select a sleeve 310, the body 312 of the sleeve is detached from the upper portion 351 at the detaching element 353 and is then used to cover a pot, as described hereinbefore for FIGS. 1 and 7.

While the sleeves 210 and 310 are herein depicted as having only one flap 246 and 346, respectively, the sleeves 210 and 310 could have more than one flap, for example, as depicted for sleeve 110 in the embodiment of FIG. 7.

The bodies 12, 112, 212 and 312 of the sleeves 10, 110, 210 and 310, respectively, may comprise any shape, whether geometric, non-geometric, asymmetrical and/or fanciful as long as they function in accordance with the present invention. In one preferred embodiment the bodies 12, 112, 212 and 312 are oversized.

Where used herein, the term "oversized" means, for instance, that the respective base portions 40, 140, 240 and 340 of the sleeves 10, 110, 210 and 310, respectively, comprise an excess amount of material sufficient for forming a crimped portion in the base portions 40, 140, 240 and 340, respectively, or skirt portions 42, 142, 242 and 342, respectively, when formed about pots disposed therein.

The sleeves 10, 110, 210 and 310 may also be equipped with drains or ventilation holes (not shown), or can be made from permeable or impermeable materials.

The material or materials from which the bodies 12, 112, 212 and 312 of sleeves 10, 110, 210 and 310, respectively, the flap 46 of sleeve 10, the flaps 146 and 152 of sleeve 110, the flap 246 of sleeve 210, the flap 346 of sleeve 310, or the entire sleeves 10, 110, 210 and 310 are constructed preferably have thicknesses in a range from about 0.1 mil to about 30 mil, although in some cases the bodies 12, 112, 212 and 312 of sleeves 10, 110, 210 and 310, respectively, the flap 46 of sleeve 10, the flaps 146 and 152 of sleeve 110, the flap 246 of sleeve 210, the flap 346 of sleeve 310, or the entire sleeves 10, 110, 210 and 310 may be much thicker, especially when the bodies 12, 112, 212 and 312 or the flaps 46, 146 and 152, 246, and 346, respectively, are constructed from multiple layers. Often, the thickness of the bodies 12, 112, 212 and 312 or the flaps 46, 146 and 152, 246, and 346, respectively, are in a range from about 0.5 mil to about 10 mil. Preferably, the bodies 12, 112, 212 and 312 and the flaps 46, 146 and 152, 246, and 346, respectively, have a thickness in a range from about 1.0 mil to about 5 mil. More preferably, the bodies 12, 112, 212 and 312 of sleeves 10, 110, 210 and 310, respectively, the flap 46 of sleeve 10, the flaps 146 and 152 of sleeve 110, the flap 246 of sleeve 210, the flap 346 of sleeve 310, or the entire sleeves 10, 110, 210 and 310 are constructed from a material which is flexible, semi-rigid, rigid, or any combination thereof. The bodies 12, 112, 212 and 312 of sleeves 10, 110, 210 and 310, respectively, the flap 46 of sleeve 10, the flaps 146 and 152 of sleeve 110, the flap 246 of sleeve 210, the flap 346 of sleeve 310, or the entire sleeves 10, 110, 210 and 310 may be constructed of a single layer of material or a plurality of layers of the same or different types of materials. Any thickness of the material may be utilized as long as the material functions in accordance with the present invention as described herein. The layers of material comprising the bodies 12, 112, 212 and 312 of sleeves 10, 110, 210 and 310, respectively, the flap 46 of sleeve 10, the flaps 146 and 152 of sleeve 110, the flap 246 of sleeve 210, the flap 346 of sleeve 310, or the entire sleeves 10, 110, 210 and 310 may be connected together or laminated or may be separate layers. Such materials used to construct the bodies 12, 112, 212 and 312 of sleeves 10, 110, 210 and 310, respectively, the flap 46 of sleeve 10, the flaps 146 and 152 of sleeve 110, the flap 246 of sleeve 210, the flap 346 of sleeve 310, or the entire sleeves 10, 110, 210 and 310 are described in U.S. Pat. No. 5,111,637, which is hereby expressly incorporated herein by reference in its entirety. Additionally, an insulating material such as bubble film, preferable as one of two or more layers, can be utilized in order to provide additional protection for the item, such as the floral grouping, contained therein.

In one embodiment, the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 may be constructed from two polypropylene films. The materials comprising the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 may be connected together or laminated or may be separate layers. In an alternative embodiment, the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 may be constructed from only one of the polypropylene films.

The body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 may also be constructed, in whole or in part, from a cling material.

"Cling Wrap or Material" when used herein means any material which is capable of connecting to the sheet of material and/or itself upon contacting engagement during the wrapping process and is wrappable about an item whereby portions of the cling material contactingly engage and connect to other portions of another material, or, alternatively, itself, for generally securing the material wrapped about, for instance, at least a portion of the pot disposed within the sleeve. This connecting engagement is preferably temporary in that the material may be easily removed, i.e., the cling material "clings" to the pot. The cling material is constructed and treated if necessary, from polyethylene such as Cling Wrap made by Glad®, First Brands Corporation, Danbury, Conn. Any thickness of cling material may be utilized in accordance with the present invention which permits the cling material to function as described herein.

The body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 is constructed from any suitable material that is capable of being formed into a sleeve and wrapped about the pot and the floral groupings disposed therein. Preferably, the material comprises paper (untreated or treated in any manner), metal foil, polymeric film, non-polymeric film, fabric (woven or nonwoven or synthetic or natural), cardboard, fiber or fibrous material, cloth, burlap, or laminations or combinations thereof.

The term "polymeric film" means a man-made polymer such as a polypropylene or a naturally occurring polymer such as cellophane. A polymeric film is relatively strong and not as subject to tearing (substantially non-tearable), as might be the case with paper or foil.

The material comprising the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 may vary in color and may consist of designs or decorative patterns which are printed, etched, and/or embossed thereon using inks or other printing materials. An example of an ink which may be applied to the surface of the material is described in U.S. Pat. No. 5,147,706 which is hereby expressly incorporated herein by reference in its entirety.

In addition, the material may have various coloring, coatings, flocking and/or metallic finishes, or other decorative surface ornamentation applied separately or simultaneously or may be characterized totally or partially by pearlescent, translucent, transparent, iridescent, neon, or the like, qualities. Each of the above-named characteristics may occur alone or in combination and may be applied to the upper and/or lower surface of the material comprising the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310. Moreover, portions of the material used in constructing the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 may vary in the combination of such characteristics. The material utilized for the body 12 and flap 46 of sleeve 10, the body 112 and flaps 146 and 152 of sleeve 110, the body 212 and flap 246 of sleeve 210, the body 312 and flap 346 of sleeve 310, or the entire sleeves 10, 110, 210 and 310 itself may be opaque, translucent, transparent, or partially clear or tinted transparent.

It will generally be desired to use the sleeves 10, 110, 210 and 310 as a covering for a potted plant comprising the pot and floral grouping as described elsewhere herein and is well known in the art. The term "pot" as used herein refers to any type of container used for holding a floral grouping or plant. Examples of pots, used in accordance with the present invention include, but are not limited to, clay pots, wooden pots, foam pots, plastic pots, pots made from natural and/or synthetic fibers, or any combination thereof. The pots are adapted to receive the floral groupings in the respective interior spaces thereof. The floral groupings may be disposed within the pot along with suitable growing or retaining mediums described in further detail below. It will also be understood that the floral groupings, and any appropriate growing or retaining mediums, may be disposed in the sleeves 10, 110, 210 and 310 without pots.

Preferably the sleeves described herein are sized to contain and conform to one of a variety of standard sized of pots known to those of ordinary skill in the art, such as 3 inch, 3½ inch, 4 inch, 4½ inch, 5 inch, 5½ inch, 6 inch, 7 inch and 8 inch pots, for example.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth and includes retaining media such as floral foam or other ballast materials.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

The bonding material may be covered by a cover material or release strip which can be removed prior to the use of the sleeves 10, 110, 210 and 310. The bonding material can be applied by methods known to those of ordinary skill in their art. One method for disposing a bonding material on a surface, in this case an adhesive, is described in U.S. Pat. No. 5,111,637, which is hereby expressly incorporated herein by reference in its entirety.

The term "bonding material" when used herein means an adhesive, frequently a pressure sensitive adhesive, or a cohesive which bonds only to a surface having another such cohesive thereon. The term "bonding material" also includes materials which are heat shrinkable or heat sealable and, in the latter instance, the adjacent portions of the material must be brought into contact and then heat must be applied to effect the seal. The term "bonding material" also includes materials which are sonic sealable and vibratory sealable. The term "bonding material" when used herein also means a heat sealing lacquer or hot melt material which may be applied to the material and, in this instance, heat, sound waves, or vibrations, also must be applied to effect the sealing. The term "bonding material" may also refer to elastic, rubber and plastic bands, ties, strings, cuffs, ribbons, stribbons, wires, collars, staples, tapes, labels, and other similar securing devices, including heat shrinkable bands or collars. These securing elements may be separate from or attached to the sleeve.

Alternatively, a cold seal adhesive may be utilized as the bonding material. The cold seal adheres only to a similar substrate, acting similarly as a cohesive, and binds only to itself. The cold seal adhesive, since it bonds only to a similar substrate, does not cause a residue to build up on equipment, thereby both permitting much more rapid disposition and use of such equipment to form articles and reducing labor costs. Further, since no heat is required to effect the seal, the dwell time, that is, the time for the sheet of material to form and retain the desired shape is reduced. A cold seal adhesive binds quickly and easily with minimal pressure, and such a seal is not readily releasable. This characteristic is different from, for example, a pressure sensitive adhesive.

The term "detaching element" as used generally herein, means any element, or combination of elements, or features, such as, but not limited to, perforations, tear strips, tear starts, zippers, and any other devices or elements of this nature known in the art, or any combination thereof, which enable or facilitate the tearing away or detachment of one object from another. Therefore, while perforations are shown and described in detail herein, it will be understood that tear strips, zippers, or any other "detaching elements" known in the art, or any combinations thereof, could be substituted therefor and/or used therewith.

Any of the sleeves described herein may be secured to or about a pot via any of the bonding materials described herein.

It will be understood that equipment and devices for forming standard floral sleeves are commercially available, and are well known to a person of ordinary skill in the art.

It will be readily appreciated by those of ordinary skill in the art that processes for making standard floral sleeves which have open upper and lower ends are well known. In the preferred embodiments of the present invention, the sleeve is constructed with a closed bottom which may simply comprise a horizontal seal along the lower end of the sleeve or more preferably the closed bottom comprises a gusset which when opened enables expansion of the bottom of the sleeves 10, 110, 210 and 310 for allowing insertion of respective pots 41 and 141 therein.

One version of the apparatus and process used to construct a sleeve as described herein is shown in FIGS. 39–44 and accompanying descriptions in U.S. Pat. No. 5,493,809, the specification of which is hereby expressly incorporated herein by reference in its entirety.

Changes may be made in the construction and the operation of the various components, elements and assemblies described herein or in the steps or the sequence of steps of the methods described herein without departing from the spirit and scope of the invention as defined in the following claims.

What is claimed is:

1. A sleeve comprising:

a body having a flat configuration and an open configuration, the body having a lower end, an upper end, an outer peripheral surface and an inner peripheral surface, the body having a base portion and a skirt portion cooperating to define an interior space; and a flap connected to a portion of the inner peripheral surface of the body at an attached area, the flap having an extending portion having a peripheral edge, the flap adapted to be positioned in one of a position wherein the flap extends downwardly toward the lower end of the body, a position wherein the flap extends upwardly, and a position wherein at least a portion of the flap extends inwardly into the interior space of the body when the body is in an open configuration wherein the flap is impregnated with or acts as a wick for any of a fertilizer, an insect repellant, an insecticide, a fungicide, a herbicide, a bactericide, water and combinations thereof.

2. The sleeve of claim 1, wherein the peripheral edge of the flap has a shape selected from the group consisting of horizontal, arcuate and convex, arcuate and concave, scalloped, inverted scalloped, sine wave, zig-zag, square wave, and diagonal.

3. The sleeve of claim 1, wherein the flap has folds to facilitate the disposition of the flap in a deployed position.

4. The sleeve of claim 1, wherein the flap has slits to facilitate the disposition of the flap in a deployed position.

5. The sleeve of claim 1, wherein when a pot and/or floral grouping and/or growing or retaining medium is disposed within the sleeve and the flap is placed in a deployed position, the position of the flap acts to secure the sleeve about the pot and/or floral grouping and/or growing or retaining medium.

6. The sleeve of claim 1, wherein the flap is constructed of a material selected from the group consisting of clear materials, printed materials, fibrous materials, cloth, fabric, polymeric materials, non-polymeric materials, paper, foil, cardboard, fiber, burlap, or laminations or combinations thereof.

7. The sleeve of claim 1, further comprising an upper sleeve portion extending a distance from the upper end of the body of the sleeve and being detachable from the body of the sleeve by a detaching element in the sleeve.

8. The sleeve of claim 7, wherein the upper sleeve portion has a plurality of holes disposed therein for supporting the sleeve from a support assembly.

9. The sleeve of claim 8 wherein the support assembly is a wicket.

10. The sleeve of claim 7 wherein the upper sleeve portion is sized to surround and enclose a floral grouping disposed within the sleeve.

11. The sleeve of claim 7 wherein the detaching element is a plurality of perforations, a tear strip, or a zipper.

12. A sleeve comprising:

a body having a flat configuration and an open configuration, the body having a lower end, an upper end, a first outer peripheral surface, a second outer peripheral surface, a first inner peripheral surface and a second inner peripheral surface, the body having a base portion and a skirt portion cooperating to define an interior space;

a first flap connected to a portion of the first inner peripheral surface of the body at an attached area, the first flap having an extending portion having a peripheral edge, the first flap adapted to be positioned in one of a position wherein the first flap extends downwardly toward the lower end of the body, a position wherein the first flap extends upwardly, and a position wherein at least a portion of the first flap extends inwardly from the first inner peripheral surface of the body into the interior space when the body is in an open configuration; and a second flap connected to a portion of the second inner peripheral surface of the body at an attached area, the second flap having an extending portion having a peripheral edge, the second flap adapted to be positioned in one of a position wherein the second flap extends downwardly toward the lower end of the body, a position wherein the second flap extends upwardly, and a position wherein at least a portion of the second flap extends inwardly from the second inner peripheral surface of the body into the interior space when the body is in an open configuration, wherein the first and second flaps are impregnated with or act as a wick for any of a fertilizer, an insect repellant, an insecticide, a fungicide, a herbicide, a bactericide, water and combinations thereof.

13. The sleeve of claim 12, wherein the peripheral edge of each of the flaps has a shape selected from the group consisting of horizontal, arcuate and convex, arcuate and concave, scalloped, inverted scalloped, sine wave, zig-zag, square wave, and diagonal.

14. The sleeve of claim 12, wherein the flaps have folds to facilitate the disposition of a flaps in the deployed position.

15. The sleeve of claim 12, wherein the flaps have slits to facilitate the disposition of the flaps in a deployed position.

16. The sleeve of claim 12, wherein when a pot and/or floral grouping and/or growing or retaining medium is disposed within the sleeve and the flaps are placed in a deployed position, the position of the flaps acts to secure the sleeve about the pot and/or floral grouping and/or growing or retaining medium.

17. The sleeve of claim 12, wherein the flaps are constructed of a material selected from the group consisting of clear materials, printed materials, fibrous materials, cloth, fabric, polymeric materials, non-polymeric materials, paper, foil, cardboard, fiber, burlap, or laminations or combinations thereof.

18. The sleeve of claim 12, further comprising an upper portion extending a distance from the upper end of the body of the sleeve and being detachable from the body of the sleeve by a detaching element in the sleeve.

19. The sleeve of claim 18, wherein the upper portion has a plurality of holes disposed therein for supporting the sleeve from a support assembly.

20. The sleeve of claim 19 wherein the support assembly is a wicket.

21. The sleeve of claim 18 wherein the upper portion is sized to surround and enclose a floral grouping disposed within the sleeve.

22. The sleeve of claim 18 wherein the detaching element is a plurality of perforations, a tear strip, or a zipper.

23. The sleeve of claim 1 wherein the sleeve has a drainage hole therein.

24. The sleeve of claim 1 wherein the sleeve is constructed of an impermeable material.

25. The sleeve of claim 12 wherein the sleeve has a drainage hole therein.

26. The sleeve of claim 12 wherein the sleeve is constructed of an impermeable material.

* * * * *